US011512861B2

(12) United States Patent
Tackabury et al.

(10) Patent No.: US 11,512,861 B2
(45) Date of Patent: Nov. 29, 2022

(54) ANOMALY DETECTION BASED ON AIRFLOW MEASUREMENT

(71) Applicant: International Business Machines Corporation, Armonk, NY (US)

(72) Inventors: Wayne Francis Tackabury, West Tisbury, MA (US); Cesar Augusto Rodriguez Bravo, Alajuela (CR); Doga Tav, Fredericton (CA)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 169 days.

(21) Appl. No.: 16/918,655

(22) Filed: Jul. 1, 2020

(65) Prior Publication Data

US 2022/0003442 A1 Jan. 6, 2022

(51) Int. Cl.

| | |
|---|---|
| ***F24F 11/32*** | (2018.01) |
| ***F24F 11/64*** | (2018.01) |
| ***F24F 5/00*** | (2006.01) |

(52) U.S. Cl.

CPC ..... *F24F 11/32* (2018.01); *F24F 5/0046* (2013.01); *F24F 11/64* (2018.01)

(58) Field of Classification Search

CPC .. F24F 11/30; F24F 11/52; F24F 11/63; F24F 11/38; F24F 11/64; G05B 2219/2614; G05B 19/042; G05B 2219/2642; G05B 23/0235

See application file for complete search history.

(56) References Cited

U.S. PATENT DOCUMENTS

| | | | |
|---|---|---|---|
| 3,357,250 | A | 12/1967 | Lowdermilk |
| 5,653,239 | A | 8/1997 | Pompei et al. |
| 8,090,817 | B2 | 1/2012 | Fowler et al. |

(Continued)

FOREIGN PATENT DOCUMENTS

| | | | |
|---|---|---|---|
| CN | 205050281 | U | 10/2015 |
| DE | 10244730 | A1 | 4/2004 |

(Continued)

OTHER PUBLICATIONS

"Intrusion Detection Systems and Subsystems," Technical Information for NRC Licensees, United States Nuclear Regulatory Commission, Mar. 2011.

(Continued)

*Primary Examiner* — Darrin D Dunn
(74) *Attorney, Agent, or Firm* — Troutman Pepper Hamilton Sanders LLP

(57) ABSTRACT

A computer-implemented method for anomaly detection in a data processing system comprising a processor and a memory comprising instructions which are executed by the processor, the method including: receiving, by the processor, a real-time airflow pattern detected from an airflow alerter, wherein the real-time airflow pattern is generated by a heating, ventilation, and air conditioning (HVAC) system in a particular facility; comparing, by the processor, the real-time airflow pattern to a predetermined airflow pattern for the HVAC system; and when the real-time airflow pattern is different from the predetermined airflow pattern, receiving, by the processor, an alert message indicating an anomaly from the airflow alerter.

19 Claims, 6 Drawing Sheets

(56) References Cited

U.S. PATENT DOCUMENTS

| | | | | |
|---|---|---|---|---|
| 8,892,495 | B2 | 11/2014 | Hoffberg et al. | |
| 8,938,367 | B2 | 1/2015 | Patel et al. | |
| 9,983,038 | B2 | 5/2018 | Corporation | |
| 10,062,254 | B1 | 8/2018 | Paul | |
| 10,506,411 | B1 * | 12/2019 | Jacob | H04W 4/90 |
| 2005/0211415 | A1 * | 9/2005 | Arts | B01D 46/121 165/59 |
| 2010/0271394 | A1 | 10/2010 | Howard | |
| 2014/0375453 | A1 | 12/2014 | Chamoux | |
| 2015/0127712 | A1 | 5/2015 | Fadell et al. | |
| 2015/0356839 | A1 | 12/2015 | Na | |
| 2016/0097555 | A1 * | 4/2016 | Lyons | F24F 11/30 702/45 |
| 2017/0331322 | A1 * | 11/2017 | Tuerk | H02J 7/04 |
| 2019/0088098 | A1 | 3/2019 | Gungamalla et al. | |

FOREIGN PATENT DOCUMENTS

| | | | |
|---|---|---|---|
| EP | 0991926 | B1 | 12/2005 |
| GB | 2528142 | A | 5/2014 |
| GB | 2554153 | A | 3/2018 |
| JP | 2004334484 | A | 5/2003 |
| JP | 1157914 | B2 | 10/2008 |
| KR | 101829725 | B1 | 2/2018 |

OTHER PUBLICATIONS

Langston, J., "In first, 3-D printed objects connect to WiFi without electronics," UW News, Dec. 5, 2017 (https://www.washington.edu/news/2017/12/05/in-first-3-d-printed-objects-connect-to-wifi-without-electronics/).

Sensirion Innovations Team, "Labs Idea #3: Intrusion / Open and Close Door Event Detection," Sensirion, Nov. 2017 (https://developer.sensirion.com/labs/intrusion-open-and-close-door-event-detection/).

Patel, Shwetak & Reynolds, Matthew & Abowd, Gregory. (2008). Detecting Human Movement by Differential Air Pressure Sensing in HVAC System Ductwork: An Exploration in Infrastructure Mediated Sensing. 1-18. 10.1007/978-3-540-79576-6_1.

* cited by examiner

ANOMALY DETECTION BASED ON AIRFLOW MEASUREMENT

TECHNICAL FIELD

The present application generally relates to anomaly detection, and more particularly, to anomaly detection based on airflow measurement.

BACKGROUND

Physical security is a top concern on cybersecurity, because if an attacker has physical access, then the amount of system intrusion threat increases exponentially, through the console port and physical port access, etc. Some companies invest a lot of money, resources, and efforts to enhance physical security and deter attackers. However, most of disaster recovery plans were designed to restore operations, rather than to restore the same level of security. Thus, companies are more vulnerable to some attacks during a disaster. For example, if there is a power outage, some security mechanisms like cameras and sensors may remain off during the power outage. Therefore, physical security is vulnerable during downtime.

Thus, it is desired to provide a security system for anomaly (e.g., intrusion, component malfunction, etc.) detection that is working around the clock, without consuming power of backup batteries in case of a power outage.

SUMMARY

Embodiments provide a computer-implemented method for anomaly detection in a data processing system comprising a processor and a memory comprising instructions which are executed by the processor, the method comprising: receiving, by the processor, a real-time airflow pattern detected from an airflow alerter, wherein the real-time airflow pattern is generated by a heating, ventilation, and air conditioning (HVAC) system in a particular facility; comparing, by the processor, the real-time airflow pattern to a predetermined airflow pattern for the HVAC system; and when the real-time airflow pattern is different from the predetermined airflow pattern, receiving, by the processor, an alert message indicating an anomaly from the airflow alerter.

Embodiments further provide a computer-implemented method for anomaly detection, further comprising: redirecting, by the processor, the alert message to a security information and event management (SIEM) system for a further analysis; and issuing, by the processor, an alert to a user.

Embodiments further provide a computer-implemented method for anomaly detection, further comprising: when the real-time airflow pattern is the same as the predetermined airflow pattern, receiving, by the processor, a heartbeat message from the airflow alerter.

Embodiments further provide a computer-implemented method for anomaly detection, wherein the airflow alerter is an anemometer, wherein the anemometer includes a memory storing the predetermined airflow pattern.

Embodiments further provide a computer-implemented method for anomaly detection, wherein the anemometer further includes one or more conductive ends and a battery, wherein the battery is charged by a wind power generated by the one or more conductive ends.

Embodiments further provide a computer-implemented method for anomaly detection, wherein the anomaly is an intrusion of an intruder or a malfunction of the HVAC system.

Embodiments further provide a computer-implemented method for anomaly detection, wherein the airflow alerter is placed on the HVAC system.

In another illustrative embodiment, a computer program product comprising a computer usable or readable medium having a computer readable program is provided. The computer readable program, when executed on a processor, causes the processor to perform various ones of, and combinations of, the operations outlined above with regard to the method illustrative embodiment.

In yet another illustrative embodiment, a system is provided. The system may comprise a full question generation processor configured to perform various ones of, and combinations of, the operations outlined above with regard to the method illustrative embodiment.

Additional features and advantages of this disclosure will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF EXEMPLARY EMBODIMENTS

The present invention may be a system, a method, and/or a computer program product for anomaly detection. The computer program product may include a computer-readable storage medium (or media) having computer-readable program instructions thereon for causing a processor to carry out aspects of the present invention.

The anomaly detection system includes an airflow alerter, which takes an analog input to detect physical intrusions. For example, the airflow alerter measures or detects airflow at a given point to create a pattern of the airflow. If the airflow measurement changes at this given point, the airflow alerter will trigger an alert regarding the detection of a physical intrusion.

In an embodiment, the airflow alerter can be integrated with heating, ventilation, and air conditioning (HVAC) system to detect the airflow. In another embodiment, the airflow alerter can be separate from the HVAC system.

The anomaly detection system can be used for bank surveillance, vault surveillance, data center surveillance, or any other system that relies on physical security both for compliance and additional measures. In an example, the anomaly detection system can be used for HVAC monitoring for the temperature-critical environment (e.g., a data center). The anomaly detection system can signal well in advance of any temperature sensors reaching a temperature threshold, thus allowing emergency remediation at an earlier stage before critical components undergo thermal danger. The anomaly detection system is at a low cost due to the simplicity of the mechanisms and components.

Figure 1:
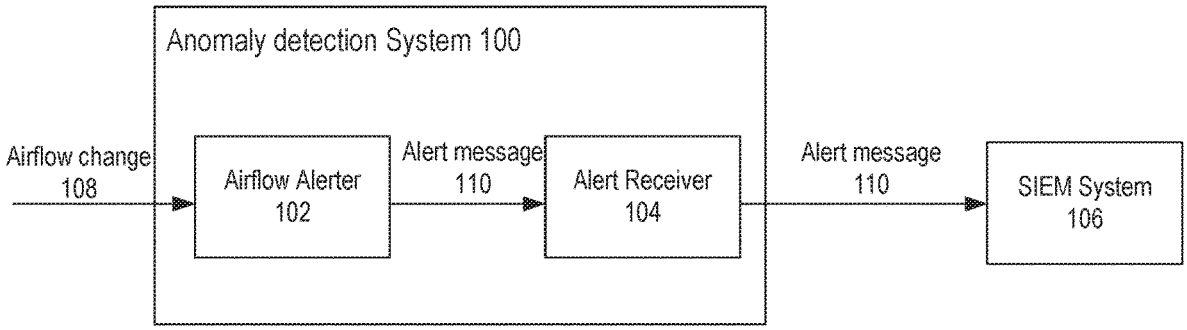
FIG. 1 depicts a schematic diagram of one illustrative embodiment of the anomaly detection system 100, according to embodiments described herein.
Figure 2A:
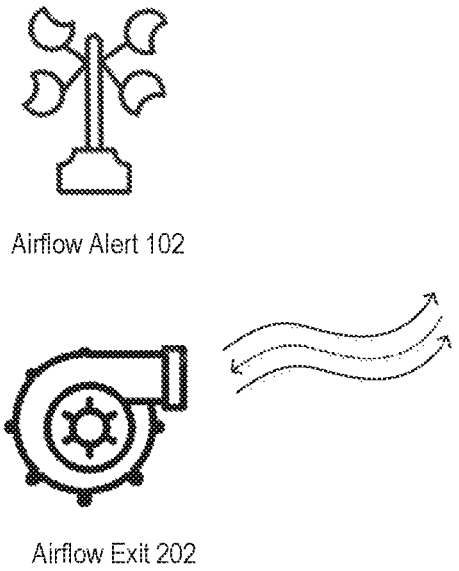
FIG. 2A depicts an exemplary regular airflow without an intruder, according to embodiments described herein.
Figure 2B:
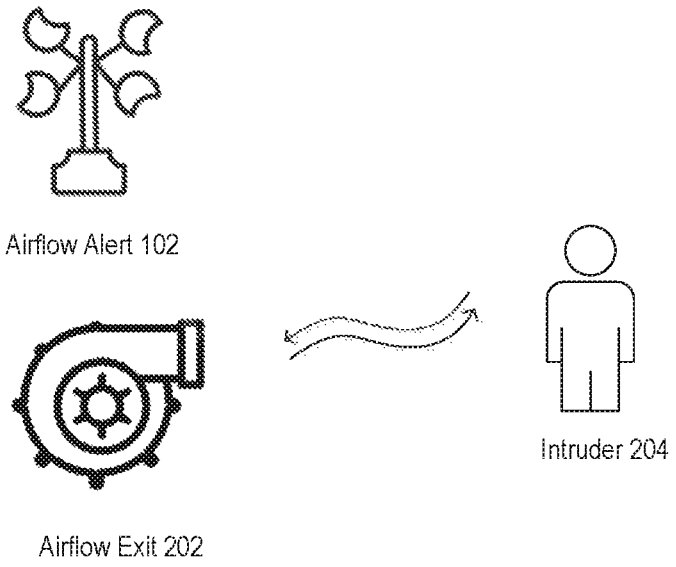
FIG. 2B depicts an exemplary abnormal airflow with an intruder, according to embodiments described herein.
Figure 3A:
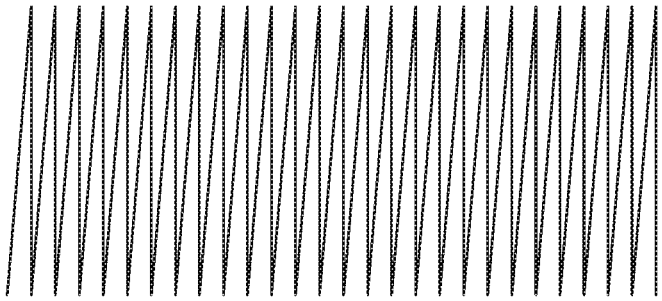
FIG. 3A depicts an exemplary regular airflow pattern, according to embodiments described herein.
Figure 3B:
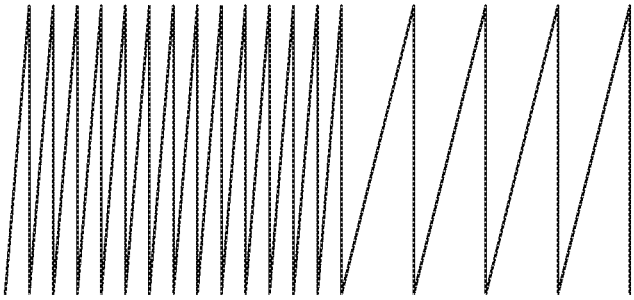
FIG. 3B depicts an exemplary abnormal airflow pattern, according to embodiments described herein.

FIG. 1 depicts a schematic diagram of one illustrative embodiment of the anomaly detection system 100, according to embodiments described herein. In an embodiment, the anomaly detection system 100 includes an airflow alerter 102 and an alert receiver 104. The airflow alerter 102 is configured to detect any airflow change 108 in a physical facility equipped with an HVAC system, e.g., a data center, a residential house, a bank, etc., and generate an alert message 110 in case of any airflow change 108. In an example, as shown in FIG. 2A, the airflow alerter 102 is placed close to an airflow exit 202 of the HVAC system. FIG. 2A depicts an exemplary regular airflow without an intruder, according to embodiments described herein. If there is no intruder 204, an exemplary regular airflow pattern can be shown in FIG. 3A. FIG. 2B depicts an exemplary abnormal airflow with an intruder, according to embodiments described herein. If there is an intruder 204 blocking the airflow exit 202, there is a change in the airflow pattern. An exemplary abnormal airflow pattern, due to an intrusion, can be shown in FIG. 3B.

The alert receiver 104 is configured to receive the alert message 110 from the airflow alerter 102. In an embodiment, the alert receiver 104 can alert an administrator to the intrusion in case of receiving the alert message 110. In another embodiment, the alert receiver 104 can redirect the alert message 110 to another local or remote receiver, e.g., a security information and event management (SIEM) system 106 (such as IBM® QRadar®). For example, the alert message 110 can be redirected to an event collector of IBM® QRadar® for further analysis through an event redirection protocol (e.g., Syslog). IBM® QRadar® is an enterprise security information and event management (SIEM) product. It collects log data from an enterprise, its network devices, host assets and operating systems, applications, vulnerabilities, and user activities and behaviors. IBM® QRadar® then performs real-time analysis of the log data and network flows to identify malicious activity, so that it can be stopped quickly, preventing or minimizing damage to the enterprise.

In an embodiment, the airflow alerter 102 can transmit the alert message 110 over User Datagram Protocol (UDP). Thus, it is unnecessary to establish a fully connected TCP session, so as to save power. In an embodiment, the alert message 110 is a Syslog message. As shown in Table 1 below, the Syslog message includes a facility code, severity level, a message tag, and message content. In an example, the facility code for security-related messages is "13." When the severity level is "1," then it indicates that a possible intrusion (e.g., due to an intruder 204) or air loss (e.g., due to malfunction of HVAC system) is detected; while when the severity level is "6," then it indicates that this Syslog message is a heartbeat message indicating that the airflow alerter 102 is in regular operation. The message tag indicates that this Syslog message is related to airflow alerter 102. The message content shows the specific content of this Syslog message.

TABLE 1

Syslog message format

| Protocol Element | Value/Usage | Notes |
|---|---|---|
| Facility Code | 13 (Security) | |
| Severity Level | 1 (Alert)<br>6 (Informational) | Alert: Intrusion detected or presumed, or airflow loss<br>Informational: Heartbeat message |
| Message: Tag/AppName | "Airflow Alerter" | |
| Message: Content | "Airflow loss, possible intrusion"<br>"Airflow Alerter Operational" | |

Figure 4:
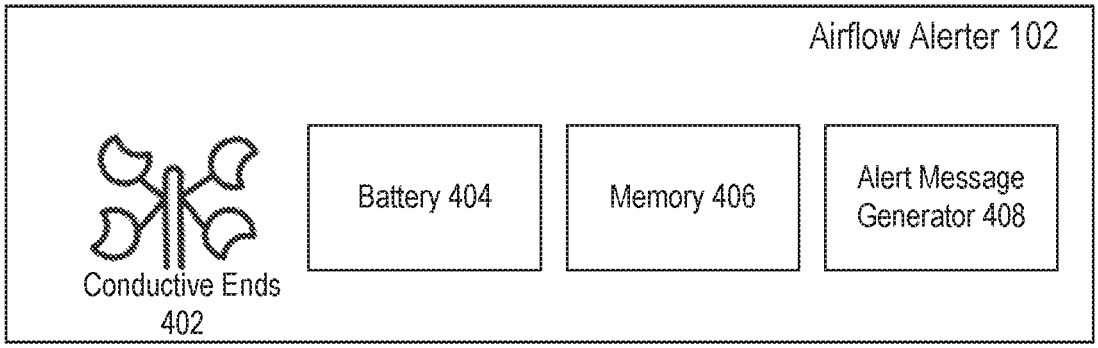
FIG. 4 depicts a schematic diagram of one illustrative embodiment of the airflow alerter 102, according to embodiments described herein.

In an embodiment, the airflow alerter 102 can be an anemometer that is used to measure the speed and direction of the airflow. In an embodiment, the airflow alerter 102 can trigger an alert if there is a change in airflow pattern. In another embodiment, the airflow alerter 102 can trigger an alert when the difference between the current airflow pattern and the regular airflow pattern is higher than a predetermined threshold (e.g., 30%), in order to reduce the number of false positives. FIG. 4 depicts a schematic diagram of one illustrative embodiment of the airflow alerter 102, according to embodiments described herein. As shown in FIG. 4, the airflow alerter 102 includes one or more conductive ends 402, battery 404, memory 406, and alert message generator 408.

The one or more conductive ends 402 are configured to collect wind data (i.e., airflow from the HVAC system), such as speed or angle of the wind. If the angle or speed of the wind changes, the airflow will also change, indicating that the airflow is blocked, e.g., due to an intrusion. The wind power can be used to charge an internal battery 404 of the airflow alerter 102, to keep the airflow alerter 102 running autonomously even in case of a power outage. In an example, the retained power in the internal battery 404 needs to be sufficient for triggering an alert, e.g., the retained power needs to be sufficient to yield a power of 2.5 watts at 1.2 volts (2.0 amps). As the airflow alerter 102 stays connected and charged through its own wind power recycle, the airflow alerter 102 becomes its own self-monitoring Internet-of-Things (IoT) node through its continuous duty cycle.

In an embodiment, the airflow alerter 102 is an embedded hardware/software system. The battery 404 is charged with an electric power continuously converted from the wind power. The battery 404 power accrues while the conductive ends 402 rotate to measure the airflow. In an example, the battery 404 power is at least 2.7-3.2 volts, so that it can enable the 32 MB flash memory to refresh over a period of alerting cycle (e.g., three minutes).

The memory 406 is configured to store a regular airflow pattern and a configuration file. In an embodiment, the memory 406 can be a 32 MB flash memory. The current airflow pattern is measured by the one or more conductive ends 402 in real time. The current airflow pattern can be compared with the regular airflow pattern to determine whether there is any change in the airflow pattern. The configuration file is used to configure a protocol (e.g., Internet Protocol version 4) and a network (e.g., 802.11 link) for transmitting an alert message, and a duration of alert message transmission (e.g., 60 seconds). In an embodiment, the configuration file can be in a JavaScript Object Notation (JSON) format.

The alert message generator 408 is configured to generate an alert message if the current airflow pattern is different from the regular airflow pattern. In an embodiment, the alert message can be generated when the difference between the current airflow pattern and the regular airflow pattern is higher than a predetermined threshold (e.g., 20%), in order to reduce the number of false positives.

Figure 5:
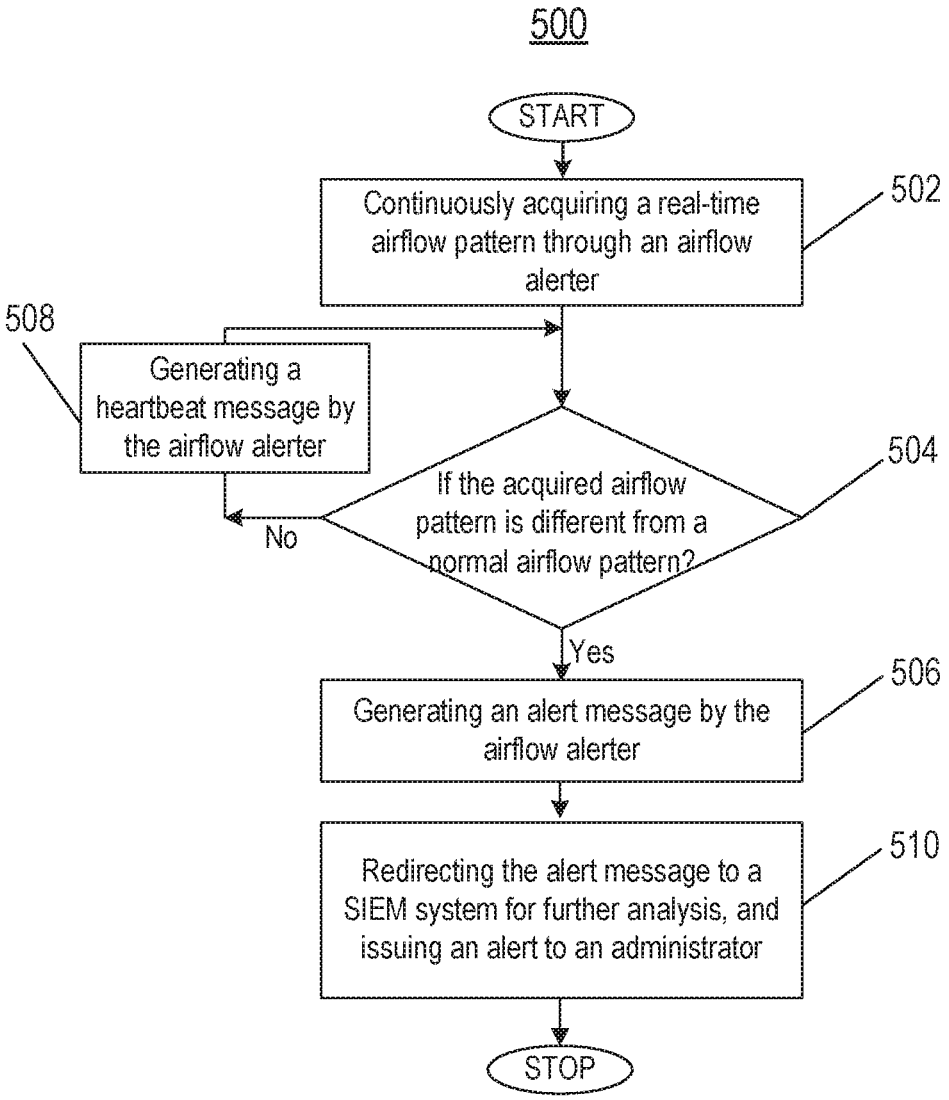
FIG. 5 depicts a flow chart of an exemplary method 500 of detecting an anomaly based on airflow measurement, according to embodiments described herein.

FIG. 5 depicts a flow chart of an exemplary method 500 of detecting an anomaly based on airflow measurement, according to embodiments described herein. At step 502, an airflow alerter is continuously acquiring a real-time airflow pattern. In an embodiment, one or more conductive ends continuously rotate to measure the airflow pattern.

At step 504, if the acquired airflow pattern is different from a regular airflow pattern, then at step 506, the airflow alerter generates an alert message. The regular airflow air pattern is stored in a memory of the airflow alerter. The change in the airflow pattern can result from an intruder or malfunction of the HVAC system.

If the acquired airflow pattern is almost the same as the regular airflow pattern, then at step 508, the airflow alerter generates a heartbeat message indicating that there is no anomaly.

At step 510, the alert message is redirected to a SIEM system for further analysis, and an alert is issued to an administrator.

In an example, a malicious intruder disconnects a web camera used to guard a hall to the CEO office, having the intent of stealing confidential information, without triggering an alert or leaving a record. When the intruder walks into the protected area (the CEO office), the anomaly detection system will detect an interruption of the airflow due to the physical movement of the intruder. Accordingly, the anomaly detection system will trigger an alert and other linked security reconciliation actions (e.g., locking the building from the inside, so that the intruder in locked in the building).

In another example, in a data center, the physical security has to be performed through devices that are continuously powered, e.g., an electronically powered lock or a surveillance camera. If a power failure is initiated by a malicious intruder, the intruder can make physical access to enterprise assets in the data center through breakage and intrusion into the physical space (e.g., creating a hole in the floor or ceiling). Generally, in the data center, the HVAC system generating the airflow is powered by a backup uninterruptable power supply (UPS) in case of power failure. For example, if the UPS device fails to work or the HVAC system fails to work, then the anomaly detection system including an airflow alerter can detect that there is no airflow. Accordingly, it will trigger an alert. For another example, the presence of the intruder leads to an interruption of the airflow. Accordingly, it will also trigger an alert. The airflow alerter can trigger an alert using its own stored power, in case of UPS failure.

In another example, an intruder breaks a plurality of lights to avoid being detected. Then he tries to sneak in through ventilation ducts to get access to the building. Thus, the airflow alerter will detect a change in airflow pattern, and then trigger a plurality of security measures (e.g., execute a loud alert, execute a blinding light, etc.).

In another example, the airflow alerter can be placed next to a window or a door of a house. If an intruder breaks into the house through the window or door, an alert can be triggered and sent to a user. For example, an alert can be sent to the user's mobile phone. In an embodiment, the airflow alerter further includes an antenna for mobile communication, e.g., Global System for Mobile Communications (GSM) antenna, 3G antenna, 4G antenna, or 5G antenna, etc. If the intruder cuts the power of the house, the airflow alerter can still trigger an alert, because the airflow alerter has retained power in the internal battery. Thus, the antenna can send the alert to the user's mobile phone even if the power of the house is cut off.

Figure 6:
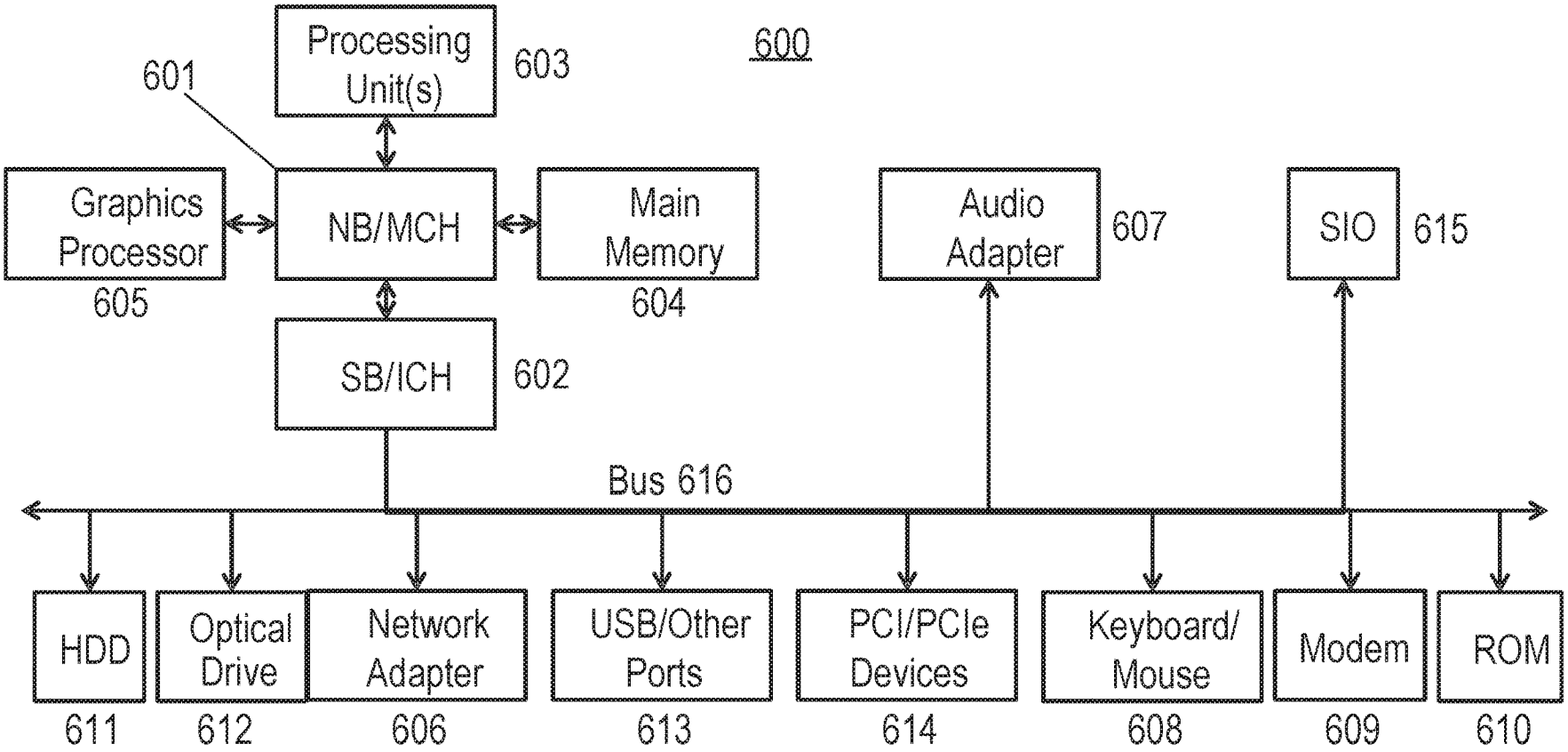
FIG. 6 is a block diagram of an example data processing system 600 in which aspects of the illustrative embodiments are implemented.

FIG. 6 is a block diagram of an example data processing system 600 in which aspects of the illustrative embodiments are implemented. Data processing system 600 is an example of a computer, such as a server or a client, in which computer usable code or instructions implementing the process for illustrative embodiments of the present invention are located. In one embodiment, FIG. 6 represents a server computing device, such as a server, which implements the anomaly detection system 100 described herein.

In the depicted example, the data processing system 600 can employ a hub architecture including a north bridge and memory controller hub (NB/MCH) 601 and south bridge and input/output (I/O) controller hub (SB/ICH) 602. Processing unit 603, main memory 604, and graphics processor 605 can be connected to the NB/MCH 601. Graphics processor 605 can be connected to the NB/MCH 601 through an accelerated graphics port (AGP).

In the depicted example, the network adapter 606 connects to the SB/ICH 602. The audio adapter 607, keyboard and mouse adapter 608, modem 609, read-only memory (ROM) 610, hard disk drive (HDD) 611, optical drive (CD or DVD) 612, universal serial bus (USB) ports and other communication ports 613, and the PCI/PCIe devices 614 can connect to the SB/ICH 602 through bus system 616. PCI/PCIe devices 614 may include Ethernet adapters, add-in cards, and PC cards for notebook computers. ROM 610 may be, for example, a flash basic input/output system (BIOS). The HDD 611 and optical drive 612 can use an integrated drive electronics (IDE) or serial advanced technology attachment (SATA) interface. The super I/O (SIO) device 615 can be connected to the SB/ICH.

An operating system can run on processing unit 603. The operating system can coordinate and provide control of various components within the data processing system 600. As a client, the operating system can be a commercially available operating system. An object-oriented programming system, such as the Java™ programming system, may run in conjunction with the operating system and provide calls to the operating system from the object-oriented programs or applications executing on the data processing system 600. As a server, the data processing system 600 can be an IBM® eServer™ System p® running the Advanced Interactive Executive operating system or the Linux operating system. The data processing system 600 can be a symmetric multiprocessor (SMP) system that can include a plurality of processors in the processing unit 603. Alternatively, a single processor system may be employed.

Instructions for the operating system, the object-oriented programming system, and applications or programs are located on storage devices, such as the HDD 611, and are loaded into the main memory 604 for execution by the processing unit 603. The processes for embodiments of the full question generation system can be performed by the processing unit 603 using computer usable program code, which can be located in a memory such as, for example, main memory 604, ROM 610, or in one or more peripheral devices.

A bus system 616 can be comprised of one or more busses. The bus system 616 can be implemented using any type of communication fabric or architecture that can provide for a transfer of data between different components or devices attached to the fabric or architecture. A communication unit such as the modem 609 or network adapter 606 can include one or more devices that can be used to transmit and receive data.

Those of ordinary skill in the art will appreciate that the hardware depicted in FIG. 6 may vary depending on the implementation. For example, the data processing system 600 includes several components that would not be directly included in some embodiments of the anomaly detection system 100. However, it should be understood that the anomaly detection system 100 may include one or more of the components and configurations of the data processing system 600 for performing processing methods and steps in accordance with the disclosed embodiments.

Moreover, other internal hardware or peripheral devices, such as flash memory, equivalent non-volatile memory, or optical disk drives may be used in addition to or in place of the hardware depicted. Moreover, the data processing system 600 can take the form of any of a number of different data processing systems, including but not limited to, client computing devices, server computing devices, tablet computers, laptop computers, telephone or other communication devices, personal digital assistants, and the like. Essentially, the data processing system 600 can be any known or later developed data processing system without architectural limitation.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a head disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network (LAN), a wide area network (WAN) and/or a wireless network. The network may comprise copper transmission cables, optical transmission fibers, wireless transmission, routers, firewalls, switches, gateway computers, and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object-oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including LAN or WAN, or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or another device to cause a series of operations steps to be performed on the computer, other programmable apparatus, or another device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical functions. In some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The present description and claims may make use of the terms "a," "at least one of," and "one or more of," with regard to particular features and elements of the illustrative embodiments. It should be appreciated that these terms and phrases are intended to state that there is at least one of the particular feature or element present in the particular illustrative embodiment, but that more than one can also be present. That is, these terms/phrases are not intended to limit the description or claims to a single feature/element being present or require that a plurality of such features/elements be present. To the contrary, these terms/phrases only require at least a single feature/element with the possibility of a plurality of such features/elements being within the scope of the description and claims.

In addition, it should be appreciated that the following description uses a plurality of various examples for various elements of the illustrative embodiments to further illustrate example implementations of the illustrative embodiments and to aid in the understanding of the mechanisms of the illustrative embodiments. These examples are intended to be non-limiting and are not exhaustive of the various possibilities for implementing the mechanisms of the illustrative embodiments. It will be apparent to those of ordinary skill in the art in view of the present description that there are many other alternative implementations for these various elements that may be utilized in addition to, or in replacement of, the example provided herein without departing from the spirit and scope of the present invention.

The system and processes of the Figures are not exclusive. Other systems, processes and menus may be derived in accordance with the principles of embodiments described herein to accomplish the same objectives. It is to be understood that the embodiments and variations shown and described herein are for illustration purposes only. Modifications to the current design may be implemented by those skilled in the art, without departing from the scope of the embodiments. As described herein, the various systems, subsystems, agents, managers, and processes can be implemented using hardware components, software components, and/or combinations thereof. No claim element herein is to be construed under the provisions of 35 USC. 112 (f), unless the element is expressly recited using the phrase "means for."

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A computer-implemented method for anomaly detection in a data processing system comprising a processor and a memory comprising instructions which are executed by the processor, the method comprising:

receiving, by the processor, a real-time airflow pattern detected from an airflow alerter, wherein the real-time airflow pattern is generated by a heating, ventilation, and air conditioning (HVAC) system in a facility;

comparing, by the processor, the real-time airflow pattern to a predetermined airflow pattern for the HVAC system;

when the real-time airflow pattern is different from the predetermined airflow pattern;

generating, by the processor, an alert message indicating an anomaly from the airflow alerter, wherein the alert message comprises a security level tag, wherein the security level tag comprises an indication of detection of an air loss, transmitting, by the processor, the alert message to an airflow receiver, and transmitting a signal to perform a security reconciliation action; and when the real-time airflow pattern is the same as the predetermined airflow pattern:

generating a normal alert message indicating that the airflow alerter is in regular operation, wherein the alert message comprises a normal security level tag, wherein the normal security level tag comprises an indication that the airflow alerter is in regular operation, and transmitting, by the processor, the normal alert message to an airflow receiver, wherein the airflow alerter includes one or more conductive ends and a battery, wherein the battery is charged by a wind power generated by the one or more conductive ends, and wherein the battery powers the airflow alerter upon the airflow receiver's receipt of the alert message.

2. The method of claim 1, further comprising:

redirecting, by the processor, the alert message to a security information and event management (SIEM) system for a further analysis; and issuing, by the processor, an alert to a user.

3. The method of claim 1, wherein the airflow alerter is an anemometer, wherein the anemometer includes a memory storing the predetermined airflow pattern.

4. The method of claim 1, wherein the airflow alerter is placed on the HVAC system.

5. The method of claim 1, wherein the anomaly alert message further comprises a message tag, wherein the message tag further comprises an indication that the anomaly alert message is related to the airflow alerter.

6. The method of claim 5, wherein the anomaly alert message further comprises a message content, wherein the message content comprises specific content of the anomaly alert message.

7. The method of claim 1, wherein the security reconciliation action comprises locking a door of the facility.

8. A computer program product for anomaly detection, the computer program product comprising a computer readable storage medium having program instructions embodied therewith, the program instructions executable by a processor to cause the processor to:

receive a real time airflow pattern detected from an airflow alerter, wherein me real-time airflow pattern is generated by a heating, ventilation, and air conditioning (HVAC) system in a facility;

compare the real-time airflow pattern to a predetermined airflow pattern for the HVAC system;

when the real-time airflow pattern is different from the predetermined airflow pattern;

generate an anomaly alert message indicating an anomaly, wherein the anomaly alert message comprises an anomaly security level tag, wherein the anomaly security level tag comprises an indication of detection of an air loss, transmitting, by the processor, the anomaly alert message to an airflow receiver, and transmitting a signal to perform a security reconciliation action; and when the real-time airflow pattern is the same as the predetermined airflow pattern:

generating a normal alert message indicating that the airflow alerter is in regular operation, wherein the alert message comprises a normal security level tag, wherein the normal security level tag comprises an indication that the airflow alerter is in regular operation, and transmitting, by the processor, the normal alert message to an airflow receiver, wherein the airflow alerter includes one or more conductive ends and a battery, wherein the battery is charged by a wind power generated by the one or more conductive ends, and wherein the battery powers the airflow alerter upon the airflow receiver's receipt of the alert message.

9. The computer program product as recited in claim 8, wherein the processor is further caused to redirect the alert message to a security information and event management (SIEM) system for a further analysis; and issue an alert to a user.

10. The computer program product as recited in claim 8, wherein the airflow alerter is an anemometer, wherein the anemometer includes a memory storing the predetermined airflow pattern.

11. The computer program product as recited in claim 8, wherein the anomaly alert message further comprises a message tag, wherein the message tag further comprises an indication that the anomaly alert message is related to the airflow alerter.

12. The computer program product as recited in claim 11, wherein the anomaly alert message further comprises a message content, wherein the message content comprises specific content of the anomaly alert message.

13. The computer program product as recited in claim 8, wherein the security reconciliation action comprises locking a door of the facility.

14. The system as recited in claim 13, wherein the anomaly alert message further comprises a message content, wherein the message content comprises specific content of the anomaly alert message.

15. A system for anomaly detection in a facility having a heating, ventilation, and air conditioning (HVAC) system, wherein the HVAC system produces a regular airflow under normal conditions, the system comprising:

an airflow alerter, the airflow alerter configured to detect a real-time airflow pattern generated by the HVAC system, wherein the airflow alerter includes one or more conductive ends and a battery, wherein the battery is charged by a wind power generated by the one or more conductive ends;

an alert receiver configured to receive an anomaly alert message from the airflow alerter;

a processor configured to:

receive the detected real-time airflow pattern;

compare the real-time airflow pattern to a predetermined airflow pattern for the HVAC system;

when the real-time airflow pattern is different from the predetermined airflow pattern, generate an alert message indicating an anomaly, wherein the alert message comprises a security level tag, wherein the security level tag comprises an indication of detection of an air loss, transmitting the anomaly alert message to an airflow receiver, and transmitting a signal to perform a security reconciliation action; and when the real-time airflow pattern is the same as the predetermined airflow pattern, generate a normal alert message indicating that the airflow alerter is in regular operation, wherein the alert message comprises a normal security level tag, wherein the normal security level tag comprises an indication that the airflow alerter is in regular operation, and transmit, by the processor, the normal alert message to an airflow receiver, wherein the battery powers the airflow alerter upon the airflow receiver's receipt of the alert message.

16. The system as recited in claim 15, wherein the processor is further configured to redirect the alert message to a security information and event management (SIEM) system for a further analysis; and issue an alert to a user.

17. The system as recited in claim 15, wherein the airflow alerter is an anemometer, wherein the anemometer includes a memory storing the predetermined airflow pattern.

18. The system as recited in claim 15, wherein the anomaly alert message further comprises a message tag, wherein the message tag further comprises an indication that the anomaly alert message is related to the airflow alerter.

19. The system as recited in claim 15, wherein the security reconciliation action comprises locking a door of the facility.

* * * * *